US005554427A

United States Patent [19]

Sera

[11] Patent Number: 5,554,427

[45] Date of Patent: Sep. 10, 1996

[54] SHEET MATERIAL EDGE LABELING

[75] Inventor: Steven A. Sera, Fresno, Calif.

[73] Assignee: Georgia-Pacific Corporation, Atlanta, Ga.

[21] Appl. No.: 785,418

[22] Filed: Oct. 15, 1991

(Under 37 CFR 1.47)

[51] Int. Cl.[6] ..... B65C 7/00

[52] U.S. Cl. ..... 428/43; 156/230; 156/288; 156/DIG. 2; 206/820; 283/56

[58] Field of Search ..... 156/230, 234, 156/288, 523, DIG. 2, DIG. 33; 206/459.5, 813, 820; 283/56; 428/40, 43

[56] References Cited

U.S. PATENT DOCUMENTS

| | | | |
|---|---|---|---|
| 2,379,934 | 7/1945 | Seiferth | 206/813 X |
| 2,687,978 | 8/1954 | Vogt | 428/43 |
| 2,703,764 | 3/1955 | Vogt | 428/43 |
| 3,174,888 | 3/1965 | Morgan | 156/DIG. 2 |
| 3,715,856 | 2/1973 | Borel | 53/41 |
| 3,809,227 | 5/1974 | Begemann | 206/264 |
| 4,472,357 | 9/1984 | Levy et al. | 422/102 |
| 4,540,880 | 9/1985 | Hipko | 235/487 |
| 4,669,611 | 6/1987 | Flaherty | 206/442 |
| 4,763,930 | 8/1988 | Matney | 283/81 |
| 4,791,014 | 12/1988 | West | 428/43 |
| 5,087,310 | 2/1992 | Robinette | 428/43 X |

*Primary Examiner*—James J. Engel
*Attorney, Agent, or Firm*—Banner & Allegretti, Ltd.

[57] ABSTRACT

A label strip for applying labeling to the edge portions of sheet products, such as plywood and other lumber sheets comprises a label strip having a series of individual labels connected together by fragile lines of perforations so as to enable easy separation of adjacent labels from one another. The label strip is adhesively backed to facilitate its application to the side edges of a stack of sheets. The strip is attached so that at least one label is retained on each sheet as the sheets are removed from the stack. The label strip may include Bar Coding and written indicia.

17 Claims, 3 Drawing Sheets

SHEET MATERIAL EDGE LABELING

BACKGROUND OF THE INVENTION

The present invention relates to labeling articles and products in general, and in particular to labeling sheet materials. More particularly, the present invention relates to applying labeling to lumber and other wood product sheets, and most particularly, this invention relates to labeling plywood and the like sheets.

Currently, wood products, plywood, particle boards, and other sheet-like products (all of which are herein referred to as lumber products or lumber sheets) are sometimes provided with labels affixed to the face of the sheets. These labels are typically pressure sensitive, and may be rather large. The face surfaces of the sheets have been used for labeling because the face surfaces of lumber sheets provide more than ample space for the label, are relatively smooth, and are relatively nonporous. Thus, these surfaces readily accept and adhere the labels in place.

However, the sheets are frequently stacked face-to-face on one another. As can be appreciated, application of the labels to the faces of a stack of sheets is difficult. In addition, when the sheets are stacked, the labels are not readily accessible to the consumer or other persons due to the obstruction caused by adjacent sheets. Furthermore, the labels can be attached anywhere on the large face surface areas of the sheets, and thus can be difficult for customers to find.

Often when purchasing lumber sheets, an individual places such sheets in a wheeled cart with the sheets situated side-by-side on their side edges within the cart. In this arrangement, viewing of the labels on the sheet faces is a cumbersome process for a cashier. Moreover, the placement of the label on the face of the sheet virtually precludes the use of automatic bar code readers. Specifically, the sizes of the sheets and the unpredictability of the labels' placement on the sheet faces renders use of the bar code scanning devices unworkable.

Furthermore, labels are generally adhered with a strong adhesive to avoid inadvertent removal of the label from the sheet. However, customers are not happy with labeling which is strongly adhered to a face surface of the sheet. These surfaces are often used in projects where they can be seen. Therefore, adhesives with high bonding strengths may cause the customer to have difficulty removing the label, to accidentally damage the sheets, or even be resigned to having the label stay on the sheet face.

These failings have long plagued the lumber industry and have resulted in the mismarking of products and slow and cumbersome check out processes. These shortcomings have led many in the industry to forego individual marking of the sheets. As a result, sheets are sold at improper prices. Due to the many various types, grades, and costs of plywood and like lumber, these problems have proven to be very substantial.

SUMMARY OF THE INVENTION

It is an object of the present invention to efficiently apply labeling to sheet materials.

It is another object of the present invention to apply labeling to sheet materials at low cost.

It is another object of the present invention to facilitate the application of labeling on large sheet materials, such as lumber sheets.

It is another object of the present invention to facilitate the accessibility of labeling applied to large sheet materials, such as lumber.

It is another object of the present invention to design labeling that will readily adhere to rough, porous, or dusty surfaces.

It is another object of the present invention to design labeling that will remain affixed even in exposure to adverse weather and the environment.

It is another object of the present invention to reduce the present problems experienced in the lumber and the like industries and to establish a situation in which large sheet materials will be properly marked and efficiently sold.

The above and other objects are achieved by making a unique label strip for labeling sheet material along its edge. More specifically, the label strip of the present invention comprises a series of individual labels separated by tearing lines of perforations. In use, the strip of labels is attached along the edge of an entire stack of sheets. As can be appreciated, the application of a strip along an edge greatly reduces the time and effort involved in labeling the sheet products as compared to the individual labeling of the faces heretofore employed. Moreover, the labels can be easily seen and read by a consumer without having to lift or move the sheets.

In a first embodiment, the distance across each label between the lines of perforations is equal to the width of the sheets. In a preferred second embodiment, the labels are sized to be smaller than the width of the sheets so that at least one label affixes to each sheet despite the presence of irregular openings present between adjacent sheets in the stack. As the sheets are removed from the stack, the labels easily separate along the tearing lines. As a result of the relative spacing of the labels on the sheets, at least one label is retained on each sheet as the sheets are removed from the stack.

Placement of the labels on the edges of the sheets also enables the seller to use bar code readers. With the labels placed on the edge of the sheet, the sheet can ordinarily be passed over the scanner because the necessary vertical clearance in the store is generally available. Moreover, a wand type scanner may be easily passed over the labels without removing the sheets from the cart in which they are stacked.

The labels of the present invention, are further provided with an adhesive which enables the label to be securely attached to the edge of the sheet products. Ordinary adhesives generally utilized to adhere labels are not usable to attach labels to the edge of a plywood sheet or like product. More specifically, the edges of plywood and the like products are rough and highly porous. The attachment of the labels in the present invention has been accomplished through the use of an adhesive generally used in the rubber tire industry. In particular, the preferred adhesive is a Fasson Co. product called "Tire Label II Adhesive". This adhesive provides very good bonding, even through adverse weather conditions. Most adhesives are unable to adhere to the side edges much less remain adhered to the edges when exposed to moisture and other adverse conditions.

The above and other objects, advantages, features and aspects of the present invention will be more readily perceived from the following description of the preferred embodiments thereof taken with the accompanying drawings and appended claims.

BRIEF DESCRIPTION OF THE DRAWINGS

The present invention is illustrated by way of example and not limitation in the Figures of the accompanying drawings, in which like references indicate like parts and in which.

DETAILED DESCRIPTION OF THE PREFERRED EMBODIMENTS

Figure 3:
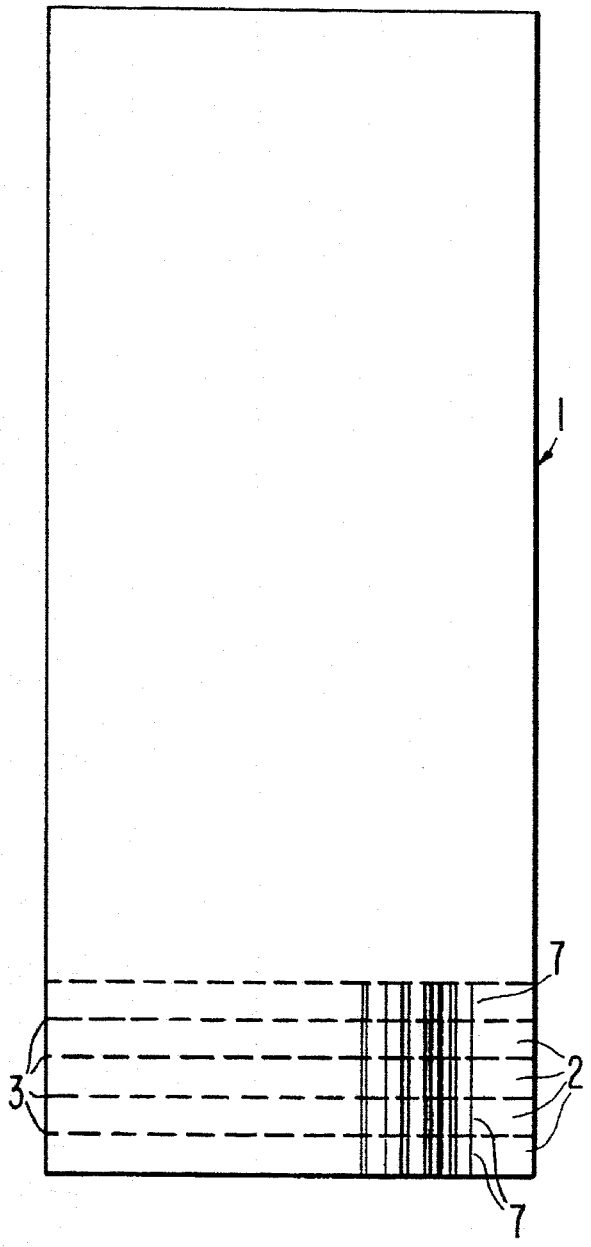
FIG. 3 is a front view of a label strip of the present invention.

Each one of the preferred embodiments is comprised of a series of labels 2 which are interconnected as a continuous strip. Most preferably, the strip is adapted to be affixed to the side edges 6 of a stack of plywood. FIG. 3 illustrates a front view of a label strip 1 according to a preferred embodiment of the present invention. The invention preferably is an adhesive backed elongated strip of bar coded labels 2. The labels are delineated by transverse lines of fine perforations 3 which form fragile connections between adjacent labels in the strip.

Most preferably, there will be no space between each label, and each label on the label strip I will be separated only by the fragile line of fine perforations 3. The use of fine perforations to create the tearing line is preferred. However, other methods for establishing a tearing line between labels (e.g., embrittling, thinning, etc.) may be used as long as the labeling is easily severed.

Figure 1:
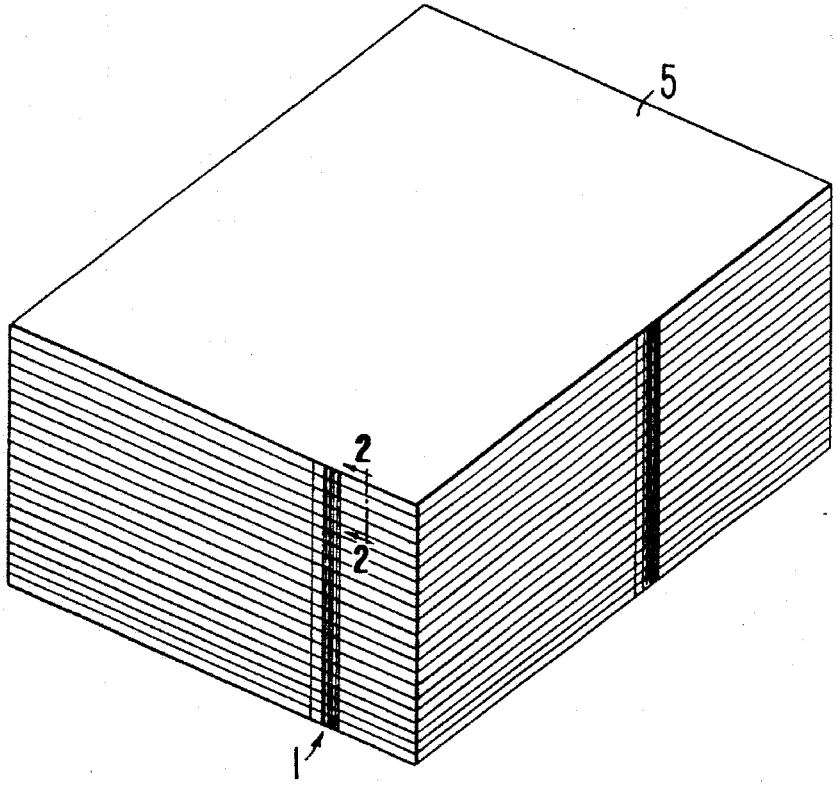
FIG. 1 is a perspective view of a plurality of stacked sheets having label strips according to the present invention adhered to the sides thereof.
Figure 2:
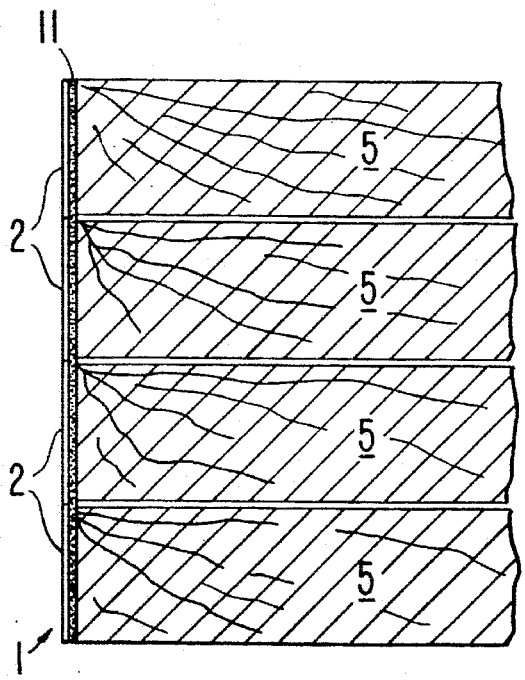
FIG. 2 is a cross sectional view taken on line 2—2 of FIG. 1.

In a first embodiment, shown in FIGS. 1 and 2, the distance across each label between the lines of perforations is generally equal to the width of the sheets. Thus, when the strip is adhered to the side of a stack of sheets with each perforation line aligned with the contacting sheet surfaces, removal of an individual sheet will cause one label strip to tear along the perforation lines. As a result, an individual bar coded label 2 will affix to the individual sheet. As can be appreciated, this embodiment of the invention is particularly well suited for sheets which can typically be stacked in a uniform manner.

Figure 5:
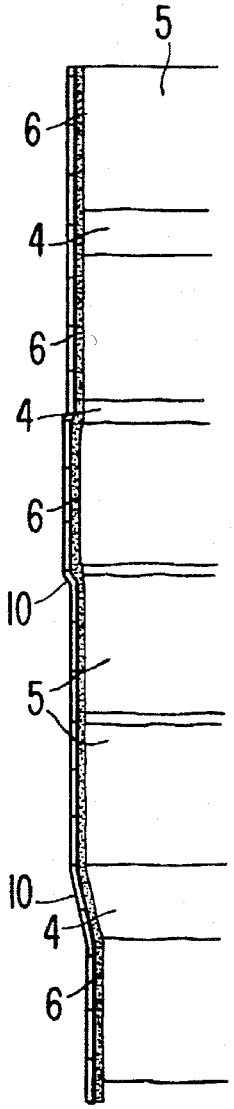
FIG. 5 is a side view of an alternative embodiment of the invention.

Plywood is typically stacked face-to-face in the retail market. However, when the plywood is stacked, irregular gaps are often formed between adjacent sheets of plywood due to warpage and the like. These gaps 4 are illustrated in FIG. 5. In this first embodiment, if gaps are present, it is preferable to remove these gaps when labels are applied so that the perforations will easily align with the contacting sheet faces. In order to remove gaps, the sheets may be clamped, bound, or otherwise pressed together. After the labels are applied, any pressing force may be removed. This is especially preferred if the sheets are to be accessible to customers. Although removal of pressing force may allow gaps to form between sheets, these gaps will no longer be a problem since the labels will be already applied; that is, the separation of the sheets will cause some of the labels to separate from each other.

A second embodiment, is shown in FIG. 5. In this embodiment, labels 2 are made substantially thinner than sheets 5 to which they are attached. As a result, each sheet will retain at least one label, and perhaps two or three labels as it is removed from the stack. The number of labels retained by each sheet depends upon the ratio chosen of the sheet thickness to the label width. This embodiment enables application of labels to the sheet edges regardless of whether any gaps are present between the sheets.

In addition to gaps 4 being present between sheets 5, the edges of the sheets are often not in alignment. Misalignment of the sheet edges can result in offset regions 10 in a label strip applied thereto. Alignment of the side edges may be difficult to obtain due to irregularities in the sheets and unmanageability of the sheets in stacking. By making the labels substantially thinner than the plywood, even a large misalignment of the side edges will not hinder placement of the labels.

The labels are preferably fabricated to have a width of about ¼ inch and applied to sheets of ⅜ inch or greater in thickness. Of course other sizes and arrangements can be used. In any event, some of the labels are affixed to one sheet, two sheets, or no sheets if completely overlying a gap. Hence as the sheets are removed from the stack, some sheets will retain a plurality of labels. This construction ensures that at least one label will remain affixed to each sheet even when irregular gaps exist between the sheets.

Gaps and edge misalignments make the location of perforations between labels imprecise with respect to the sheets. Thus, the ability to affix labels by aligning the perforations with the contacting sheet faces is not possible in most usages. Even if the sheet edges are aligned and there are no gaps between sheets, the second embodiment is still beneficial since alignment of the perforations with the contacting sheet faces is not necessary. This fact is especially beneficial when the labels are applied manually rather than automatically since the risk involved with human error is eliminated.

The label is composed of a material that will be strong enough to avoid tearing, except at the location of the weakened perforations, when a sheet is removed. In the second embodiment discussed above, a single label may be affixed over the edges of two adjacent sheets. To maintain the label substantially intact, the label material must have a greater strength than the force of the adhesive affixing the label to the edge. Thus, as a sheet is removed, the overlapping label will be removed from the sheet edge of one of the sheets, by pulling away from the adhesive force affixing it thereto and tearing along the perforation line.

A preferred label material which Applicant has found to have desirable characteristics is a material made by the Fasson Co. of Painesville, Ohio called "Tire Label II". This label consists of a bleached kraft base paper with an enamel glossy finish that is latex impregnated for conformability and flexibility. This label material also has good environment withstanding qualities. Thus, this material can be used on plywood even when stored outside and exposed to adverse conditions such as moisture. In addition, the label can also be printed on a special emulsion paper which is strong, has the ability to withstand the elements, and will remain intact even in moist climates. Nevertheless, other materials may also be used to make the labels.

Most preferably, the label itself will be Butt Cut to a one piece liner (not shown). The one piece liner may be a wax coated or the like liner upon which the strip is located. The one piece liner serves to protect and cover the adhesive on the back of the label strip. The label is easily removed from the liner due to the non-adherence quality of the strip thereto. The liner is removed from the label strip prior to its placement on the stack of sheets.

Figure 4:
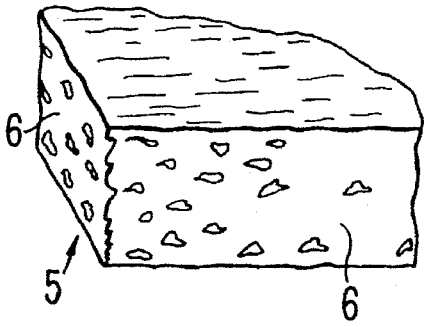
FIG. 4 is a broken perspective view of a corner of a rectangular plywood sheet.

As illustrated in FIG. 4, the plywood side edges 6 typically have rough, dusty, gritty, and exceptionally porous characteristics. The edges of the sheets are typically significantly more porous, dusty, gritty and rough than the faces of the sheets. These side edges therefore do not readily accept adhesives. Consequently, adhesive 11 must be a unique adhesive. Adhesive 11 must be carefully selected in order to provide suitable attachment to the plywood side edges.

An adhesive which has proven to be most preferable is "Tire Label II Adhesive" made by the Fasson Company for use with the "Tire Label II" label material discussed above. This adhesive was originally designed for labeling rubber tires. To Applicant's knowledge, this adhesive has not be used to affix labels to side edges of lumber products. This adhesive is a very strong pressure sensitive adhesive and has been determined by Applicant to adhere well to the side edges of plywood and the like items, despite their dusty, porous, rough, and irregular edge surfaces.

This adhesive is a highly aggressive permanent adhesive. It is a rubber-based pressure sensitive adhesive which has a service temperature range of −65 degrees Fahrenheit to +150 degrees Fahrenheit. Product data sheets obtained from Fasson indicate that this adhesive has been tested for adhesion values on four selected substrates with results as listed in the table below. The middle column of the table indicates pounds per inch-width of the Tire Label II ten minutes after application. The right column of the table indicates pounds per inch-width of the Tire Label II twenty four hours after application.

| SUBSTRATES | 10 MIN APPLIED (LBS/IN.-WIDTH) | 24 HR APPLIED (LBS/IN.-WIDTH) |
|---|---|---|
| Stainless Steel | 5.2 | 6.1 |
| Painted Metal | 5.4 | 6.3 |
| Particle Board | 3.1 | 4.0* |
| Tire Tread | 1.2 | 1.3 |

*(Fiber Pull)

In addition, plywood and the like edges are porous and generally allow moisture to migrate beneath the label very easily. In these situations, most adhesives will not adequately hold a label in place. Accordingly, adhesives typically used in the lumber industry are not adequate for retaining the labels to the sheet edge. The Fasson Co. "Tire Label II Adhesive" is of a nature to enable lumber and the like sheet materials to be stored or left outside in the environment or otherwise exposed to adverse weather conditions, such as moisture. Most adhesives are unable to adhere to the side edges, much less remain adhered to the edges when exposed to moisture and other adverse conditions.

In addition to the above adhesive, in another preferred embodiment, Applicant has discovered that it is desirable to use an auxiliary tacking agent (not shown) to help the labels adhere to the product. Such a tacking agent remains tacky, or sticky, and does not "dry out" for prolonged periods. The auxiliary tacking agent helps keep out moisture, and especially helps enable the label to be affixed to the dusty, gritty, rough, and porous surfaces. Applicant has found that adequate auxiliary tacking agents are products produced by the Minnesota Mining and Manufacturing Company of Saint Paul, Minn., called "Spray 77" and "Spray 90". In application, the auxiliary tacking agent is preferably placed upon the sheet edges prior to affixing the label strip.

The label strips are preferably very long and stored in a rolled, tape-like manner. These rolls preferably consist of approximately 3,000 labels to ease handling by the person applying the labels. As a result, the labels can be placed by hand upon the sheets, conveniently, easily, and efficiently. The labels can thereby be applied in a manner similar to applying common household or commercial rolled adhesive tapes, i.e. by removing a portion of appropriate length, by unrolling the strip slowly as the labels are applied, pressing the label strip in place, and tearing the strip along a tearing line once the entire stack is labeled. Preferably, the labels of the present invention are applied after production of the products; that is, they are preferably applied after the sheet products are in condition for sale to customers. For example, they may be applied at the store site where such products are to be sold.

Figure 6:
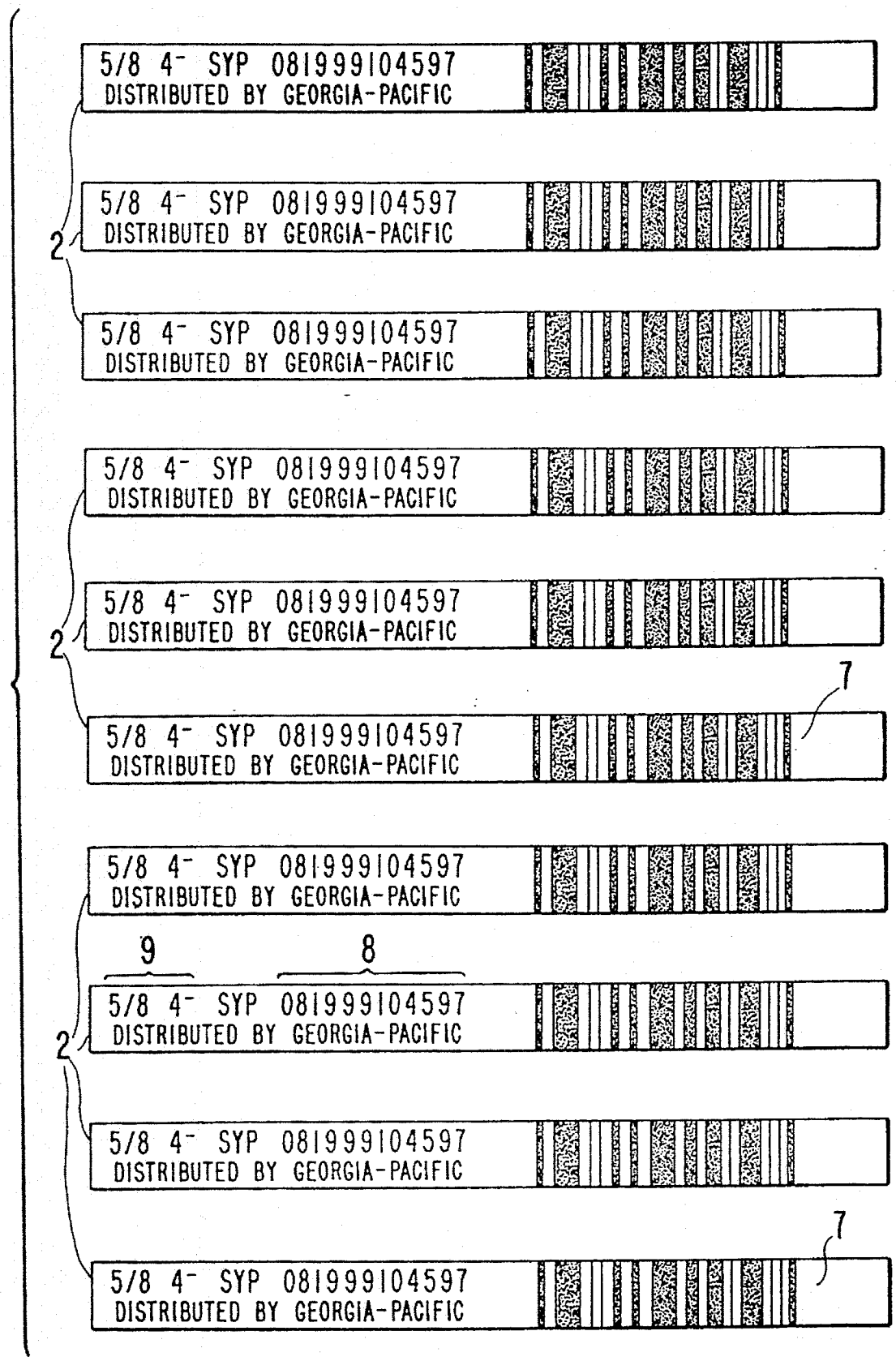
FIG. 6 is a front view of a plurality of labels, which illustrates an embodiment of the invention having both Bar Coding and written indicia.

As shown in FIG. 6, the label surface will preferably be printed to include a Bar Code 7 for electronic reading, Human Readable Code numbers 8, and a product description 9. Applicant's preferred label marking includes Bar Code lines extending across the width of the label. Some types of sheet material are very thin, such as considerably less than one inch wide. Despite the small label widths necessary for thin sheets, applicant's Bar Code arrangement provides a clearly readable Bar Code as well as sufficient spacing for such Bar Coding.

In addition, any human readable code number or product description is preferably marked lengthwise along the labels, as illustrated in FIG. 6. Preferably, Human Readable Code numbers 8 are located near or adjacent the Bar Coding for ease in viewing and reading. Although Human Readable Code numbers are typically located above or below the Bar Coding, it is preferred that such numbers are located to the side of the Bar Coding because of the narrow width of the label. As a result, the Bar Coding is able to span substantially across the label's width, as shown in FIG. 6. This arrangement provides an easy to read and scan label which will have a predictable orientation, i.e. being aligned with the sheet edge as opposed to an unpredictable orientation when placed on the sheet face. Therefore, the label can be quickly and easily observed.

In addition, a label strip may be placed on more than one side edge, or even on all side edges, as illustrated in FIG. 1, so that the sheets do not have to be manipulated in order to present the labeling to a specific side.

In a preferred embodiment, labels 2 are made ¼" wide by 3" long. These dimensions have the advantage of being usable on many different size sheets. Common thickness for lumber sheets are in increments of ¼", ⅜", ½", ⅝", and ¾". In addition, the labels have a sufficient length for providing Bar Coding, Human Readable Coding to the side thereof, and the product description. The ¼" wide label will function similar to the first embodiment when used with ¼" wide sheets. In addition, the ¼" wide label will function as in the second embodiment when used with larger sheets. Therefore, the ¼" wide label will function especially well with sheets having a width of ⅜" wide or greater.

Lumber sheets, such as plywood sheets, are sold in many various size dimensions. Typically, these products are large and unwieldy. For example, some common sizes are 4' wide by 8' long and 4' wide by 4' long rectangular sheets. Depending on the particular sheet used these sheets can have a variety of weights. It is not unusual for these sheets to weigh as much as fifty lbs., or even more. The present invention becomes even more useful and desirable over the prior labeling techniques as the sizes and weights of the lumber sheets becomes greater. The present invention helps minimize the amount of sheet manipulation required and, thus, is even more desirable with larger sheets. However, the present invention is still highly advantageous for smaller lumber sheets, such as 1' wide by 1' long, or even smaller sheets. In addition, although the Figures show the present invention with respect to rectangular sheets, this present invention is intended for use with all types of shapes, such as oval, circular, or even complex shapes.

Applicant has invented a label structure and method which, among other benefits, has an added benefit in that Bar Coded Labels, which have not been previously found beneficial with lumber sheets due to the prior-noted problems, may now be constructively used in the lumber industry.

Although the present invention is especially beneficial in the labeling of lumber sheet products, this invention has application to the labeling of any product having edge portions which may be substantially aligned. It is preferable that products are located against, or in contact with, adjacent products. However, this invention is also applicable with products which are spaced or separated as long as they are proximate one another. Furthermore, although the present invention has been described with reference to particular embodiments, it will be apparent to those skilled in the art that variations and modifications can be substituted therefor without departing from the principles and spirit of the invention.

I claim:

1. A label and sheet system comprising:

a plurality of lumber sheets, each said lumber sheet having two generally planar opposite sides and a peripheral edge, said generally planar opposite sides being generally parallel and having a length and width substantially greater than the depth of the edge of said lumber sheet, said plurality of lumber sheets being arranged face-to-face adjacent one another, and a label strip comprising a plurality of labels arranged end-to-end, each said label having upper and lower ends, said labels being connected by fragile tearing lines which delimit said upper and lower ends, said label strip being adhered to said edges of said lumber sheets, said upper and lower ends of said labels extending generally parallel said planar sides of said lumber sheets, each said lumber sheet having a plurality of said labels adhered thereto such that removal of an individual sheet will remove a plurality of labels therewith.

2. A labeling system comprising:

a plurality of building products each including a pair of faces and at least one relatively thin edge, each said edge having a width extending between said faces, said building products being generally arranged face-to-face against one another with said edges being placed adjacent one another in a row such that non-uniform spaces are defined between said adjacent edges; and an elongate label strip extending transversely across said edges of said building products, said label strip having a series of individual labels separated from one another by tearing lines extending transversely across said label strip, said tearing delimiting upper and lower ends of said labels, each said label having a width extending between said upper and lower ends thereof, said widths of said labels being less than said widths of said edges, and an adhesive for attaching said label strip to said edges.

3. The labeling system of claim 2 wherein a plurality of labels are attached to said edge of each building product.

4. The labeling system of claim 2 wherein said labels are each composed of a material which has a greater strength characteristic than the force of said adhesive which adheres said labels to said edges of said building products so that each said label remains substantially intact when separated from an edge to which said label was partially affixed.

5. The labeling system of claim 2 wherein said labels each includes a front surface facing away from said edges and bar code indicia marked on said front surface.

6. The labeling system of claim 5 wherein said labels each further includes human readable code indicia on said front surface.

7. The labeling system of claim 2 wherein said building products are lumber building products.

8. The labeling system of claim 2 wherein said adhesive has the capacity to adhere the labels to said edges of said building products in dry and wet environments.

9. A labeling system comprising:

a plurality of lumber building products each including a pair of faces and at least one relatively thin edge which is rough and porous, each said edge having a width extending between said faces, said lumber building products being arranged face-to-face against one another with said rough and porous edges being placed adjacent one another in a row; and an elongate label strip extending transversely across said rough and porous edges of said lumber building products, said elongate label strip having a series of individual labels separated from one another by tearing lines extending transversely across said strip, said tearing lines delimiting upper and lower ends of said labels, each said label having a width extending between said upper and lower ends thereof, said widths of said labels being less than said widths of said edges, and adhesive means for securely adhering said labels to said rough and porous edges of said lumber building products in wet and dry environments.

10. The labeling system of claim 9 wherein said labels are each composed of a material which has a greater strength characteristic than the force of said adhesive means adhering said labels to said rough and porous edges of said lumber building products so that each said label remains substantially intact when separated from an edge to which said label was partially affixed.

11. The labeling system of claim 9 wherein said labels each includes a front surface facing away from said edges and bar code indicia marked on said front surface.

12. A labeling system comprising:

a plurality of building products each including a pair of faces and at least one relatively thin edge, said building products being generally arranged face-to-face against one another with said edges being placed adjacent one another in a row, each said edge having a width extending between said faces; and an elongate label strip extending transversely across said edges of said building products, said label strip having a series of individual labels separated from one another by tearing lines extending transversely across said label strip, said tearing lines delimiting upper and lower ends of said labels, each said label having a width extending between said upper and lower ends, said widths of said labels being less than said widths of said edges, and an adhesive for attaching said label strip to said edges.

13. The labeling system of claim 12 wherein a plurality of labels are attached to said edge of each building product.

14. The labeling system of claim 12 wherein said labels are each composed of a material which has a greater strength characteristic than the force of said adhesive which adheres said labels to said edges of said building products so that each said label remains substantially intact when separated from an edge to which said label was partially affixed.

15. The labeling system of claim 12 wherein said labels each includes a front surface facing away from said edges and bar code indicia marked on said front surface.

16. The labeling system of claim 12 wherein said building products are lumber building products.

17. The labeling system of claim 12 wherein said adhesive has the capacity to adhere the labels to said edges of said building products in dry and wet environments.

* * * * *

UNITED STATES PATENT AND TRADEMARK OFFICE

CERTIFICATE OF CORRECTION

PATENT NO. : 5,554,427

DATED : September 10, 1996

INVENTOR(S) : Steven A. Sera

It is certified that error appears in the above-identified patent and that said Letters Patent is hereby corrected as shown below:

Column 7, line 49,
Claim 2, line 13, insert --lines-- after "tearing".

Signed and Sealed this

Third Day of December, 1996

*Attest:*

Bruce Lehman

BRUCE LEHMAN

*Attesting Officer*

*Commissioner of Patents and Trademarks*